US006210129B1

(12) United States Patent
Stiefel

(10) Patent No.: US 6,210,129 B1
(45) Date of Patent: Apr. 3, 2001

(54) HIGH-PRESSURE PUMP FOR A FUEL INJECTION DEVICE OF AN INTERNAL COMBUSTION ENGINE

(75) Inventor: Hans-Peter Stiefel, Ditzingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/194,257

(22) PCT Filed: Dec. 24, 1997

(86) PCT No.: PCT/DE97/03011

§ 371 Date: Nov. 25, 1998

§ 102(e) Date: Nov. 25, 1998

(87) PCT Pub. No.: WO98/44258

PCT Pub. Date: Oct. 8, 1998

(30) Foreign Application Priority Data

Mar. 27, 1997 (DE) ..... 197 12 872

(51) Int. Cl.[7] ..... F04B 17/00
(52) U.S. Cl. ..... 417/360; 417/364; 464/901
(58) Field of Search ..... 417/360, 364, 417/470; 464/901; 123/507, 508, 509, 495

(56) References Cited

U.S. PATENT DOCUMENTS 4,473,359 * 9/1984 Davis ..... 464/88
4,842,497 * 6/1989 Hafele et al. ..... 123/495
4,966,530 * 10/1990 McCusker et al. ..... 417/360
4,978,282 * 12/1990 Fu et al. ..... 417/360
5,275,538 * 1/1994 Paliwoda et al. ..... 464/901
5,482,432 * 1/1996 Paliwoda et al. ..... 464/901
5,551,389 * 9/1996 Kahrs ..... 123/196 R
5,556,264 * 9/1996 Simonette ..... 417/360
5,626,466 * 5/1997 Ruoff et al. ..... 417/470
5,794,594 * 8/1998 Fehlmann ..... 123/495
5,820,358 * 8/1998 Kushida et al. ..... 417/420
5,937,734 * 8/1999 Stiefel ..... 417/470
5,967,123 * 10/1999 Ruoff et al. ..... 123/495

* cited by examiner

*Primary Examiner*—Timothy S. Thorpe
*Assistant Examiner*—Michael K. Gray
(74) *Attorney, Agent, or Firm*—Ronald E. Greigg; Edwin E. Greigg

(57) ABSTRACT

The present invention relates to a high-pressure pump for a fuel injection device of an internal combustion engine, with a pump housing, with at least one work chamber disposed in the pump housing functionally between an inlet region and a supply region. A working element is movably disposed in the work chamber, and a pump shaft is provided in the pump housing by means of which the working element can be driven. In order to obtain a shortened structural length, and an extended service life of the pump, a provision is made that the pump housing can be fastened to a wall of a motor housing of the internal combustion engine, wherein the pump shaft can be radially supported against a shaft of the internal combustion engine, which shaft is supported in the motor housing.

21 Claims, 3 Drawing Sheets

Fig. 2a
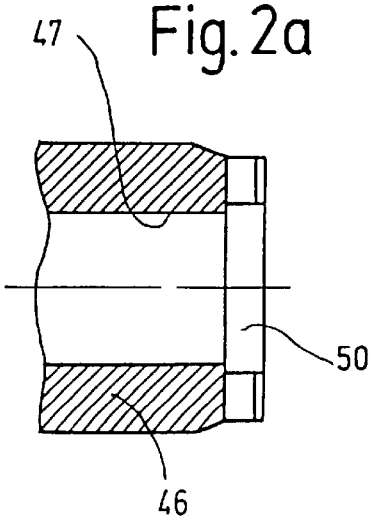
Fig. 3
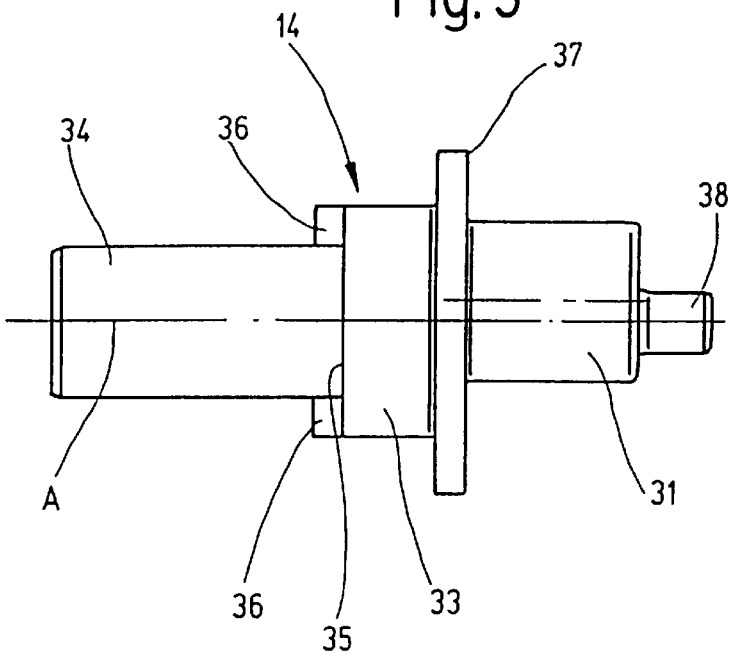
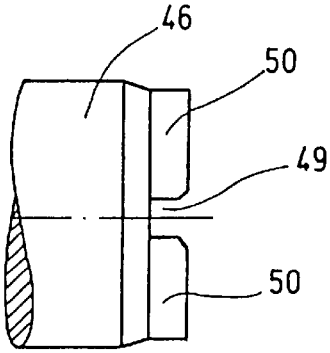
Fig. 2b
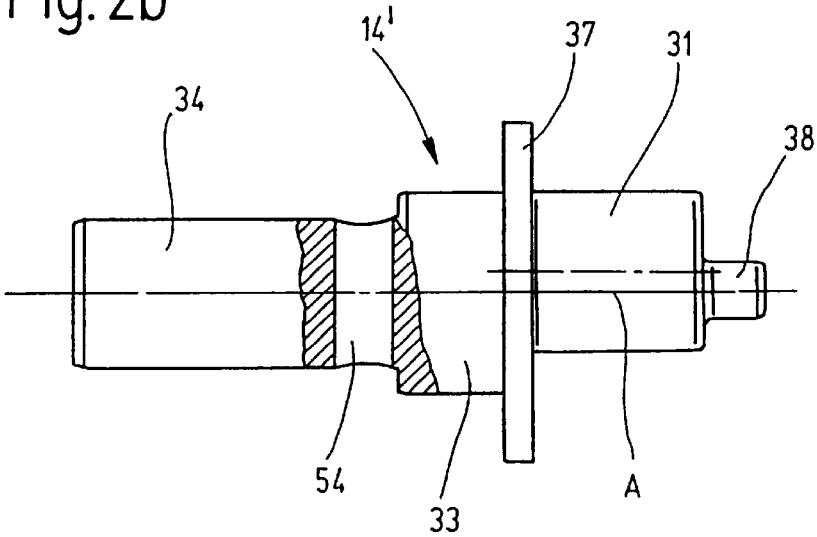
Fig. 4

HIGH-PRESSURE PUMP FOR A FUEL INJECTION DEVICE OF AN INTERNAL COMBUSTION ENGINE

The invention relates to a pump, in particular a high-pressure pump for a fuel injection device of an internal combustion engine;

PRIOR ART

DE 44 19 927 A1 has disclosed a high-pressure pump for fuel embodied as a piston pump, and a piston/cylinder unit, which contains a work chamber, disposed in the pump housing of this high-pressure pump, and a pump shaft for driving the piston/cylinder unit is supported in this pump housing. The pump shaft is supported in its center and, on its cantilevered drive-side end, supports a cam which is used to act on the piston/cylinder unit. In order to drive the pump shaft, a drive gear is fastened to its end protruding from the pump housing.

The support of the pump shaft in the pump housing results in a relatively large structural length of the pump, which consequently has a relatively large space requirement. In addition, a relatively costly drive connection from a motor shaft to the drive gear is required, which likewise requires a certain amount of installation space in the engine compartment. Furthermore, large bearing loads are produced, which lead to an increased wear and to a reduced service life since the effective bearing length is relatively small compared to the length of the drive-side end of the pump shaft protruding from the bearing.

DE 42 17 910 A1 has disclosed a hydraulic pump driven by an internal combustion engine, which is disposed in a cavity in a cylinder head wall. An end of a cam shaft, on which a cam is non-rotatably disposed, which drives a piston of a pump element, extends into this cavity through an opening in the cylinder head wall. After the insertion of the pump element and the attachment of the cam to the cam shaft end, the cavity in the cylinder head wall is closed by means of a cap.

This known pump, which is used as a lubricant pump, does indeed have a relatively short structural length, but cannot be produced independently of the internal combustion engine. Furthermore, the function of this known pump and of its individual pump elements can only be tested after installation into the cylinder head wall of the engine.

ADVANTAGES OF THE INVENTION

The pump according to the invention, has the advantage over the prior art that through the non-rotatable support of the pump shaft on a shaft of the drive motor, no bearings are needed for the pump shaft in the pump housing so that a shortened structural length of the pump is produced. Moreover, the elimination of the bearing of the pump shaft in the pump housing results in an increased service life.

Furthermore, the pump according to the invention can be manufactured as a separate subassembly and can be tested as to its function independently of the internal combustion engine. In transport and storage, in order to prevent uncontrolled movements of the movable pump elements and therefore to prevent damage and problems in the subsequent installation, in a preferred exemplary embodiment of the invention, a transport securing device is provided for the pump shaft, which preferably has two securing means spaced apart from each other.

It is particularly advantageous if the passage of the pump shaft out of the pump housing is sealed since the pump interior is thus protected from impurities during storage, transport, and installation.

In order to be able to compensate for a radial play in the bearing of the shaft of the internal combustion engine without influencing the tightness of the pump, in an advantageous embodiment of the invention, the provision is made that the passage of the pump shaft out of the pump housing is sealed by means of an axial shaft seal in which two smooth faces are pressed tightly against each other. As a result, a perfect seal can be assured, even with an eccentric motion of the sealing faces in relation to each other.

A particularly non-problematic installation of the pump is produced if the pump shaft has a drive-side bearing pin which can be slid into a corresponding axial bore in the shaft of the internal combustion engine. This embodiment also permits the particularly simple connection of an auxiliary drive, which is necessary for a test operation of the pump for testing purposes.

Advantageous improvements and updates of the piston pump disclosed are possible by means of the measures taken hereinafter.

BRIEF DESCRIPTION OF THE DRAWINGS

Exemplary embodiments of the invention are shown in a simplified form in the drawings and will be explained in more detail in the subsequent description.

FIG. 2*a* shows a section through the drive-side end of a shaft of an internal combustion engine for use with a pump according to the invention.

FIG. 2*b* shows a side view, rotated by 90°, of the end of the shaft according to FIG. 2*a,*

FIG. 3 shows a side view of a pump shaft for the pump according to FIG. 1, FIG. 4 shows a side view of a pump shaft for a pump according to a second exemplary embodiment of the invention.

Parts that correspond to one another are provided with the same reference numerals in the different Figs. of the drawings.

DESCRIPTION OF THE EXEMPLARY EMBODIMENTS

Figure 1:
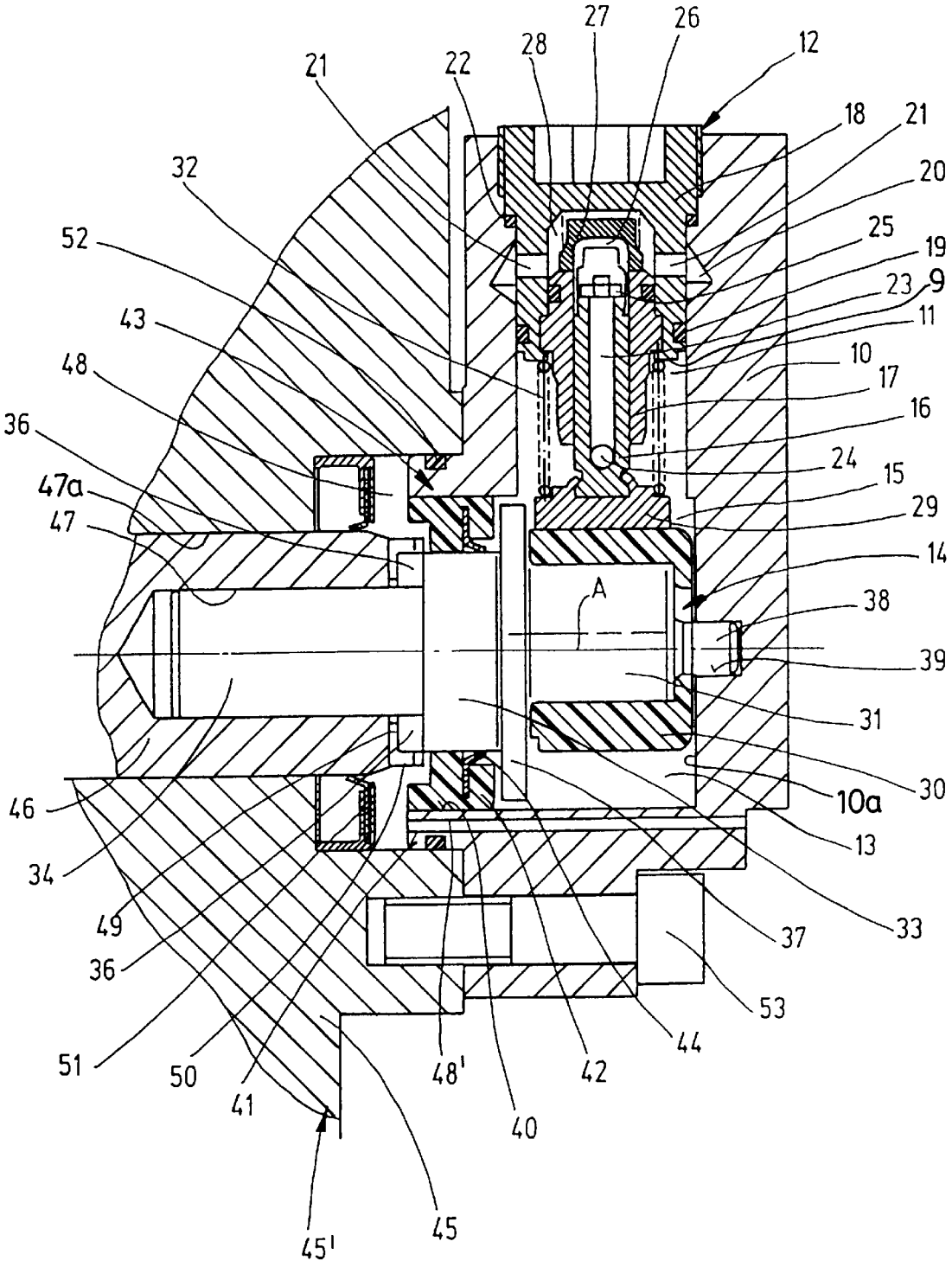
FIG. 1 shows a section through a pump according to a first exemplary embodiment of the invention.

As shown in FIG. 1, a pump according to the invention includes a pump housing 10 with one or more containing regions 11 each for a pump element 12, and a containing region 13 in which a pump shaft 14 is disposed with its drive-side end formed as a cam 31. The containing region 13 for the drive-side end of the pump shaft 14, together with sections of the containing region(s) 11 oriented toward it, constitutes an inlet region 15 for a medium to be supplied at a relatively low pressure, in particular for fuel at precompression. By way of an inlet line, not shown, the inlet region 15 is connected to a low-pressure inlet connection, not shown, on the pump housing 10.

As a working element, the pump element 12 includes a piston 16, which is guided so that it can move in a piston guide 17. The piston guide 17 is inserted into a securing part 18, which holds the pump element 12 in the containing region 11 of the pump housing 10. On the outer circumference of the securing part 18, in the region of its inner end 9, a seal 19 is provided, which seals the inlet region 15 in relation to a supply region 20, in which the medium to be supplied is pumped with relatively high pressure, in particular with high pressure, and this supply region encompasses the securing part 18 in the region of outlet bores 21 provided in the securing part 18. By way of a line, not shown, the supply region 20 is connected to a high-pressure outlet connection, not shown, on the pump housing 10. The supply region 20 is sealed in relation to the outside by means of a seal 22 between the securing part 18 and the inner housing wall that encloses the containing region 11 for the pump element 12.

The piston 16 has an axial inlet conduit 23, which opens out at the end of the piston 16 disposed in the piston guide 17 and is connected to the inlet region 15 by way of a laterally extending inlet bore 24 in the end of the piston 16 protruding from the piston guide 17. At the mouth of the axial inlet conduit 23, the piston 16 has an inlet valve 25 and thus defines a work chamber 26 in the piston guide 17 and this chamber can be closed in relation to a high-pressure outlet region 28 by an outlet valve 27. The high-pressure outlet region 28 is connected to the supply region 20 by way of the outlet bores 21.

The inlet valve 25 is embodied so that it opens during the intake stroke of the piston 16, i.e. when the piston is moving out of the piston guide 17, so that during the intake stroke, medium to be supplied can flow from the inlet region 15, through the inlet bore 24, the inlet conduit 23, and the open inlet valve 25, into the work chamber 26. During the supply stroke, i.e. when the piston 16 is moving into the piston guide 17, the inlet valve 25 closes so that the medium enclosed in the work chamber 26 is put under pressure. As soon as the pressure in the work chamber 26 achieves a high pressure predetermined by the outlet valve 27, this valve opens and the high-pressure medium to be supplied can be pumped through the open outlet valve 27, the high-pressure outlet region 28, the outlet bores 21, and into the supply region 20, from which it flows through the line, not shown, to the high-pressure outlet connection on the pump housing 10.

A slide shoe 29 is connected to the free end of the piston 16 protruding from the piston guide 17, and with it, the piston 16 is supported by way of a stroke ring 30 that is rotatably supported on a cam 31 of the pump shaft 14, which cam is used as a crank element, so that the piston 16 can be driven by the pump shaft 14. In order to hold the piston 16 in contact with the stroke ring 30 by way of the slide shoe 29 during the intake stroke of the piston 16, a spring 32 is provided, which is supported with its one end against the slide shoe 29 and with its other end against the securing part 18.

As can be seen particularly well in FIG. 3, the pump shaft 14 has a sealing collar 33, which on the end remote from the cam 31, is adjoined by a bearing pin 34 that has a reduced diameter in relation to the sealing collar 33. On the shoulder 35 formed between the bearing pin 34 and the sealing collar 33, catch lugs 36 are provided that are disposed diametrically opposite each other with regard to the pump shaft axis A. Between the sealing collar 33 and the cam 31, a circumferential securing piece 37 is provided, whose outer diameter is greater than that of the sealing collar 33. An auxiliary pin 38 is connected to the free end face of the cam 31 and is aligned coaxial to the bearing pin 34.

As shown in FIG. 1, the pump shaft 14 is inserted into the pump housing 10 so that its auxiliary pin 38 travels with radial play in an auxiliary bore 39 in an inner housing wall 10*a* provided in the pump housing 10, while the sealing collar 33 rests in the region of a through opening 40 of the pump housing 10, which opening is encompassed by a centering collar 41 extending axially with regard to the pump shaft axis A. In this connection, the centering collar 41 and the auxiliary bore 39 are aligned coaxially to each other.

A radial shaft seal 43 is inserted in a sealed fashion into the through opening 40 and its inner diameter is greater than the outer diameter of the sealing collar 33. A support face 42 is provided on the inner diameter of the radial shaft seal 43. To seal the inlet region 15 or the containing region 13 for the cam 31 of the pump shaft 14, there is a sealing lip 44 in the radial shaft seal 43 whose inner diameter is smaller than the outer diameter of the sealing collar 33. Consequently, the sealing lip 44 is deformed by the sealing collar 33 and rests against it in a sealed fashion. In lieu of the sealing lip 44, a grooved ring or the like can also be used, for example.

In the storage and transport of the pump, i.e. of the independent subassembly comprised of the pump housing 10, pump element 12, pump shaft 14, and radial shaft seal 43, the pump shaft 14 is pressed by the spring(s) 32 and held with its sealing collar 33 against the support face 42 provided on the radial shaft seal 43 and is held with the auxiliary pin 38 against the inner wall of the auxiliary bore 39. The sealing lip 44 of the radial shaft seal 43 can only be deformed by half the diameter difference between the inner diameter of the support face 42 and the outer diameter of the sealing collar 33. This diameter difference is laid out so that a constant deformation of the sealing lip 44 is prevented. The inner diameter of the sealing lip 44 is suitably chosen so that the sealing lip 44 seals the interior of the pump against dust and dirt, even when it is deformed in the manner described during transport and storage. The radial shaft seal 43 is formed and the sealing lip 44 is incorporated so that the pump shaft 14 comes to rest against the support face 42 before the sealing lip 44 can be damaged by crushing.

The sealing collar 33 and the support face 42 of the radial shaft seal 43, together with the auxiliary pin 38 and the auxiliary bore 39, thereby constitute a transport securing device for the pump shaft 14 in the pump housing 14, which holds the pump shaft 14 essentially in its later operating position in the pump housing 10 when the pump is not attached to the motor housing 45'. In this connection, it is advantageous that the support face 42, which constitutes a first securing means, and the auxiliary bore 39, which constitutes a second securing means, are spaced axially apart from each other so that the pump shaft 14 cannot tilt in the pump housing 10. In this way, the piston(s) 16 can in particular be prevented from being pulled too far out of the associated piston guide(s) 17, which can result in problems upon installation of the pump, particularly in damage to the pistons 16 when sliding back in.

In lieu of the auxiliary bore 39, an auxiliary pin or the like can also be provided as a second securing means on the inner wall of the pump housing 10. In this instance, a corresponding auxiliary bore or the like would then have to be disposed in or on the cam 31.

In addition, during transport and storage, the securing piece 37 on the pump shaft 14, together with the radial shaft seal 43, is used to secure the pump shaft against falling out.

In order to mount the pump—i.e. the independent subassembly comprised of the pump housing 10, pump element 12, pump shaft 14, and radial shaft seal 43—to a wall 45 of an internal combustion engine and thereby to bring the pump shaft 14 into engagement with a driven shaft 46 which is supported in a bore 47*a* of the internal combustion engine, e.g. with a cam shaft, first the bearing pin 34 of the pump shaft 14 is slid into an axial bearing bore 47, in particular embodied as a fitted bore, in the shaft 46 and then, the centering collar 41 is slid into a receiving bore 48 coaxial to the shaft 46 of the internal combustion engine. In the course of this, the catch lugs 36 on the shoulder 35 of the pump shaft 14 enter into a groove 49 on the end face of the shaft 46, which groove acts as a catch recess and is provided in an end-face collar 50, as particularly shown in FIGS. 2*a* and 2*b*. The pump shaft 14 is consequently supported radially by means of the insertion of the bearing pin 34 of the pump shaft 14 into the bearing bore 47 of the shaft 46 and is supported in the shaft 46 of the internal combustion engine fixed against relative rotation by means of the interlocking of the catch lug 36 with the groove 49.

The radial support of the pump shaft 14 against the shaft 46 of the internal combustion engine can also be produced in the reverse manner, with a bearing pin on the shaft 46 and a bearing bore in the pump shaft 14. It is furthermore possible to respectively provide both the shaft 46 of the internal combustion engine and the pump shaft 14 with a bearing bore and to use a bearing pin that is inserted into both bearing bores in order to support the pump shaft 14 against the shaft 46 of the internal combustion engine. Parts that protrude well beyond the pump housing 10 or the motor housing 45' and can be easily damaged particularly during transport can therefore be avoided, particularly on both the as yet unmounted pump and the internal combustion engine.

The axial support of the pump shaft 14 can be carried out in almost any arbitrary manner since only very low bearing forces have to be absorbed here. For example, the pump shaft 14 with the auxiliary pin 38 can be supported against the bottom of the auxiliary bore 39 or can be supported with the end face of the cam 31 directly against an opposing inner wall of the pump housing 10 or can be supported against this wall by way of the stroke ring 30. In the other axial direction, the axial support of the pump shaft 14 can be carried out for example by the support of the catch lugs 36 against the shaft 46 of the internal combustion engine or by the support of the securing piece 37 against the support ring 44.

Figure 5:
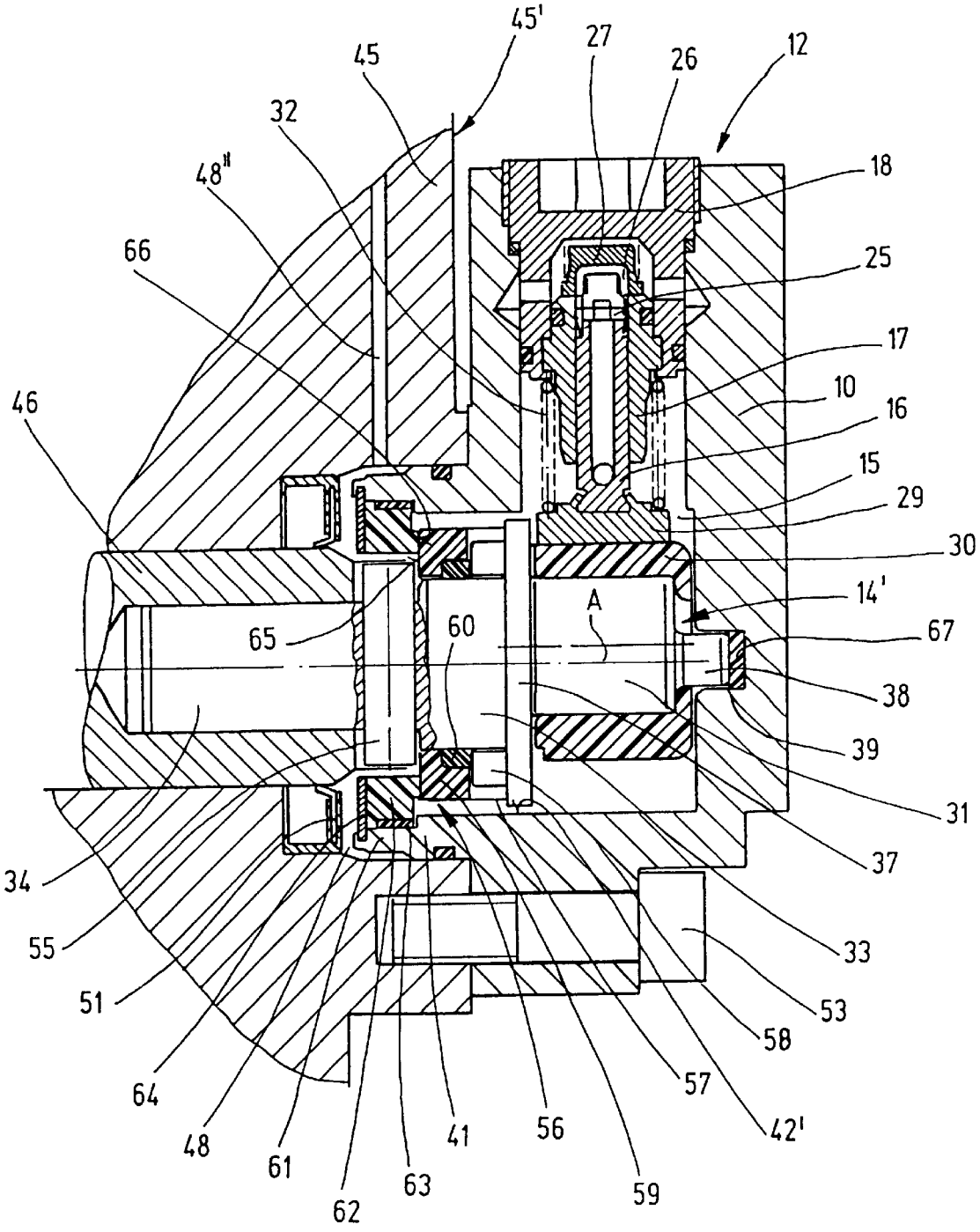
FIG. 5 shows a section through a pump according to the second exemplary embodiment of the invention.

In the receiving bore 48, a leakage chamber is formed for medium to be supplied, in particular fuel, leaking from the inlet region 15 through the radial shaft seal 43 and this chamber is sealed in relation to the outer environment by means of a sealing ring 52 employed on the outer circumference face of the centering collar 41 and is sealed in relation to the shaft 46 and therefore in relation to lubrication oil from its shaft bearing by means of a lip seal 51. This leakage chamber is evacuated, for example by way of a bore 48' in the pump housing 10, which can be connected in a manner not shown in detail to an intake tube of the internal combustion engine if the medium to be supplied is fuel. In lieu of the bore 48' in the pump housing 10, a bore 48" can also be provided in the motor housing 45', as shown in FIG. 5.

By means of a continual evacuation of the leakage chamber, the lip seal 51, which is designed to produce a seal in relation to lubrication oil, is protected from damaging effects of the medium to be supplied, in particular fuel. This permits the service life of the lip seal 51 to be extended.

Since the receiving bore 48 in the wall 45 of the internal combustion engine is aligned coaxial to the driven shaft 46 and since the centering collar 41 is likewise aligned coaxial or concentric to the auxiliary bore 39, the pump shaft 14—which is supported with its bearing pin 34 in the bearing bore 47 of the shaft 46, which bore is embodied as a fitted bore—is also aligned with its auxiliary pin 38 coaxial to the auxiliary bore 39 and with its support collar 33 coaxial to the radial shaft seal 43. Since furthermore, the outer diameter of the auxiliary pin 38 is smaller than the inner diameter of the auxiliary bore 39 and since the outer diameter of the sealing collar 33 is smaller than the diameter of the support face 42 on the radial shaft seal 43, during operation, i.e. when the pump shaft 14 is driven by the internal combustion engine by way of the shaft 46—preferably the camshaft, the pump shaft 14 runs freely in the pump housing 10 without a separate radial support in it and without touching anywhere.

The subassembly comprised of the pump housing 10, pump element 12, pump shaft 14, and radial shaft seal 43, which is connected to the wall 45 of the motor housing 45' of the internal combustion engine, can be fastened to the wall 45 of the engine, for example, by means of screws 53 only one of which is shown.

In lieu of the described pump shaft 14 with the catch lugs 36, a pump shaft 14' can also be used which in the bearing pin 34 adjacent to the sealing collar 33, has a lateral bore 54 into which a catch pin 55 is inserted, as shown in FIG. 5 in connection with a second exemplary embodiment of the invention, and this catch pin 55 extends beyond the outer circumference of the bearing pin 34 to the point that it can be brought into catching contact with the grooves 49 on the shaft 46 of the internal combustion engine.

As FIG. 5 shows, the second exemplary embodiment of the pump according to the invention includes a pump housing 10 in which one or a number of pump elements 12 and a pump shaft 14' are disposed. The design and the disposition of the pump element 12 corresponds to the design described in conjunction with FIG. 1. The pump shaft 14' differs from the pump shaft described in conjunction with FIGS. 1 and 3 only by means of the differing embodiment of the catch means for the rotationally fixed support against the shaft 46 of the internal combustion engine. In lieu of the radial shaft seal 43 provided in the pump according to FIG. 1, however, an axial shaft seal 56 is provided in the pump shown in FIG. 5 in order to seal off the inlet region 15 in relation to the receiving bore 48 in the wall 45 of the internal combustion engine.

The axial shaft seal 56 includes a catch 57 press-fitted onto the sealing collar 33 and, adjacent to the securing piece 37, a spring 58 and a pressing ring 59 are inserted into this catch on the side of the spring 58 remote from the securing piece 37. In addition, a sealing ring 60 is disposed between the pressing ring 59 and the sealing collar 33 and seals the pressing ring 59 in relation to the sealing collar 33 so that the pressing ring 59 can move in the axial direction for the purpose of tolerance compensation.

A slide ring 62 is inserted into an axial extension 61 of the centering collar 41 and supports a sealing ring 63 on its outer circumference. A disk 64, which is fastened to the extension 61 of the centering collar 41, for example by means of crimping, holds the slide ring 62 together with the sealing ring 63 in the containing region of the extension 61 of the centering collar 41.

In the assembly of the pump according to FIG. 5, first the catch 57, the spring 58, the sealing ring 60, and the pressing ring 59 are mounted in this order on the sealing collar 33 of the pump shaft 14'. Then the catch pin 55 is inserted into the lateral bore 54. Since the length of the catch pin 55 is greater than the outer diameter of the sealing collar 33 or is greater than the inner diameter of the pressing ring 59, the catch pin 55 secures the parts of the axial shaft seal 56 disposed on the pump shaft 14' against the sealing collar 33 and is consequently used to secure them against falling out, in particular for the pressing ring 59 as long as it is not yet resting against the slide ring 62.

As soon as the pump shaft 14' is inserted into the pump housing 10 and the parts of the axial shaft seal 56 secured in the axial extension 61 of the centering collar 41 are mounted, the pressing ring 59 is pressed by the spring 58 with its end face 65 remote from the spring 58, which end constitutes a radial sealing face disposed crosswise to the pump shaft axis A, against an end face on the slide ring 62, which represents a slide face 66 that is used as a sealing face. The force of the spring 58, which is disposed between the pressing ring 59 and the securing piece 37, is supported against the pump housing 10 by way of the securing piece 37, the cam 31, and the auxiliary pin 38.

In this connection, the axial shaft seal 56 functions as a first securing means of the transport securing device while the disk 64 that holds the slide ring 62 in the extension 61 of the centering collar 41 is used to secure it against falling out during transport and storage of the pump.

In order to supply a low-friction axial slide bearing for the pump shaft 14' during operation of the pump, a disk 67 is inserted into the auxiliary bore 39, which supports the auxiliary pin 38 in the axial direction and is preferably made of a low-friction material, in particular of a slide bearing material.

The use of the above-described axial shaft seal 56 in the pump according to the invention has the advantage that a possible radial play of the shaft 46 of the internal combustion engine, which leads to an eccentric rotation of the pump shaft axis A and therefore to an eccentric rotation of the pressing ring 59, has no influence on the sealing of the pump since the sealing surfaces resting against each other are smooth and are disposed perpendicular to the desired course of the pump shaft axis A. A tilting of the pressing ring 59 in relation to the sealing collar 33 due to the radial play of the shaft 46 of the internal combustion engine is compensated for in this connection by means of the spring 58 and the sealing ring 60.

The pump according to the invention, which has been described by way of example in conjunction with radial piston pumps with one pump element 12 or a number of pump elements 12, preferably three disposed in a star pattern, can also be embodied as an axial piston pump. Furthermore, it is also possible to embody the pump according to the invention, in which the pump shaft 14, 14' is inserted in a sealed fashion into the pump housing 10 without a separate bearing in this housing and can be supported in a drive shaft radially and in such a way that it is fixed against relative rotation, as an internal gear pump or the like. In a particularly advantageous manner, the invention can be used in all pump types in which one or a number of working elements are intended to be driven by way of a cam of a pump shaft.

In particular, the pump according to the invention has the advantage that it can be manufactured as a separate subassembly, independently of other parts and can be tested as a completely preassembled, already sealed subassembly directly at the manufacturer. As a result, the pump operation in particular, i.e. both the functioning of the individual pump elements 12 and their cooperation with the pump shaft 14, 14' as well as the tightness, can also be fully tested. A further advantage is comprised in that with the subsequent installation in the final position of use, i.e. on an internal combustion engine, no installation dirt can penetrate into the pump. Furthermore, the elimination of the bearing of the pump shaft 14, 14' in the pump housing 10 extends the service life of the pump.

The transport securing device provided in the pump according to the invention significantly facilitates the subsequent installation of the pump on the motor housing 45' since the pump shaft 14, 14' and therefore also the bearing pin 34 are secured essentially in the operating position provided.

In a particularly reliable manner, the use of an axial shaft seal furthermore permits a sealing of the pump independent of tolerances of the shaft 46 of the internal combustion engine, in particular independent of its radial play.

Dimensionally stable, fuel resistant materials that are matched to each other in the best way with regard to friction and wear can be used as materials for the pressing ring 59 and the slide ring 62. The spring 58 provides for a uniform and constant surface pressure, which is largely independent of measurement tolerances and wear, between the surfaces of the pressing ring 59 and the slide ring 62 sliding against each other, i.e. between the end face 65 and the slide face 66.

In the exemplary embodiment shown in FIG. 1, the support face 42 is provided indirectly against the pump housing 10 by way of the radial shaft seal 43. However, it is also possible, for example, to match the outer diameter of the securing piece 37 to the diameter of the through opening 40 so that before the mounting of the pump housing 10 onto the motor housing 45', the pump shaft 14 or 14' can be supported at the through opening 40 by way of the circumferential securing piece 37. In this variant, the through opening 40 is used as a support face 42' provided directly on the pump housing 10 (FIG. 5). The support face 42 or 42' is therefore respectively connected at least indirectly to the pump housing 10.

There is a diametrical difference, i.e. a radial distance, between the support face 42 or 42' and the region of the pump shaft 14 or 14', which rests against the support face 42, 42' before the mounting of the pump housing 10 onto the motor housing 45', wherein the distance is dimensioned so that as soon as the pump is mounted onto the motor housing 45', the pump shaft 14, 14' cannot touch the support face 42 or 42', independent of possibly occurring radial runout of the shaft 46.

The foregoing relates to a preferred exemplary embodiment of the invention, it being understood that other variants and embodiments thereof are possible within the spirit and scope of the invention, the latter being defined by the appended claims.

What is claimed is:

1. A high-pressure pump for a fuel injection device of an internal combustion engine, comprising a pump housing, with at least one work chamber disposed in the pump housing functionally between an inlet region and a supply region, a working element is movably disposed in said at least one work chamber, a pump shaft provided in the pump housing by means of which the at least one working element is driven, for use, the pump housing (10) is fastened to a wall (45) of a housing (45') of the internal combustion engine, wherein in use the pump shaft (14, 14') is radially supported by a bearing-drive means driven by rotation of a shaft (46) of the internal combustion engine, said shaft is (46) rotated in and supported by bearing means in the internal combustion engine housing (45').

2. The pump according to claim 1, in which a transport securing device (33, 42, 42', 38, 39; 33, 56, 38, 39) is provided for securing the pump shaft (14; 14') in place in the pump housing said transport securing device holds the pump shaft (14; 14') essentially in an operating position during a time period in which the pump housing (10) is not mounted to the housing (45') of the internal combustion engine.

3. The pump according to claim 2, in which the transport securing device includes first and second securing means (42, 42'; 56 or 39), which are spaced apart from one another in a direction of a longitudinal axis of the pump shaft (14, 14').

4. The pump according to claim 3, in which the first securing means (42, 42'; 56) supports the pump shaft (14; 14') in a through opening (40) provided in the pump housing (10), while the second securing means (39) is engaged by an auxiliary pin (38) connected to a cam (31) of the pump shaft (14; 14') inside the pump housing.

5. The pump according to claim 1, in which with a cam (31) drive-side end, the pump shaft (14,14') is guided in a seal (43) in a through opening (40) provided in the pump housing (10).

6. The pump according to claim 5, in which the pump shaft (14; 14') has a sealing collar (33) thereon that cooperates with said seal (43; 56) that encompasses the pump shaft (14; 14') in order to seal the pump housing (10) in the through opening for the pump shaft (14; 14').

7. The pump according to claim 6, in which a support face (42, 42') that encompasses the pump shaft (14, 14') is provided at least indirectly in the pump housing (10) and a diameter of the support face is greater than a corresponding diameter of the pump shaft (14, 14').

8. The pump according to claim 6, in which the seal (43) encompassing the pump shaft (14; 14') has a sealing lip (44) disposed on a radial inside of said seal (43), said sealing lip (44) rests with an inner circumference against the sealing collar (33) and an inner diameter of said sealing lip (44) is smaller than an outer diameter of the sealing collar (33).

9. The pump according to claim 6, in which an axially movable pressing, sealing ring (59) is disposed on the sealing collar (33) of the pump shaft (14') and with an end face (65), said sealing ring is pressed against a radially stationary slide face (66), which is provided on a slide ring (62) that is inserted into the through opening (40) for the pump shaft (14') and is axially fixed at least in one direction.

10. The pump according to claim 6, in which on a side of the sealing collar (33) associated with the pump housing (10), the pump shaft (14, 14') supports a securing piece (37) that protrudes radially outward beyond the sealing collar (33).

11. The pump according to claim 6, in which the seal (43; 56) encompassing the pump shaft (14; 14') includes or constitutes a first securing means (42; 56).

12. The pump according to claim 1, in which the pump shaft (14, 14') includes a bearing pin (34) which protrudes from the pump housing (10) and engages a corresponding axial bearing bore (47) in the shaft (46) of the internal combustion engine.

13. The pump according to claim 1, in which a catch means (36; 55) is provided on the pump shaft (14; 14'), and when the pump is mounted to the internal combustion engine, said catch means engages at least one catch (49) provided on an engaging end of the shaft (46) of the internal combustion engine.

14. The pump according to claim 13, in which a catch pin (55) that extends lateral to the pump shaft (14') is provided as a catch means, and said catch pin (55) protrudes outward beyond the outer circumference of the bearing pin (34).

15. The pump according to claim 14, in which the catch pin (55) extends lateral to the pump shaft (14') through a corresponding lateral bore (54) and protrudes outward beyond the sealing collar (33) on at least one side.

16. The pump according to claim 1, in which for the alignment of the pump shaft (14, 14') in the pump housing (10), said pump housing is provided with a centering means (41), which is aligned with a through opening (40) for the pump shaft (14, 14') and cooperates with a corresponding centering means (48) that surrounds the shaft (46) of the internal combustion engine and is disposed on the wall (45) of the motor housing (45').

17. The pump according to claim 16, in which said centering collar (41) encompasses the through opening (40) for the pump shaft (14, 14') and is inserted into a receiving bore (48) in the wall (45) of the motor housing (45'), said centering collar in said receiving bore serves as a centering means and is coaxial to the shaft (46) of the internal combustion engine.

18. The pump according to claim 16, in which the pump shaft (14, 14') has a support means (38) on a cam end inside the housing of the pump shaft that cooperates with a second securing means (39) disposed on the pump housing (10), wherein the second securing means (39) is aligned coaxial to the centering means (41).

19. The pump according to claim 18, in which as a support means, the pump shaft (14, 14') has an auxiliary pin (38) that is coaxial to a bearing pin (34) and engages an auxiliary bore (39) of the pump housing with a radial clearance therebetween and said bore (39) is coaxial to the centering means (41) and is used as the second securing means.

20. The pump according to claim 19, in which the auxiliary pin (38) is supported in the auxiliary bore (39).

21. The pump according to claim 19, in which a disk (67), which is used as an axial bearing, is inserted into the auxiliary bore (39) and is comprised of a low-friction slide bearing material.

* * * * *